United States Patent [19]

Mitchell

[11] 4,068,674

[45] Jan. 17, 1978

[54] CAMPERS TENTING WITH A COMBINATION OF ENTRY AND SUPPORT MEANS

[76] Inventor: Hal D. Mitchell, Box 226, Rte. 4, Rolla, Mo. 65401

[21] Appl. No.: 712,205

[22] Filed: Aug. 6, 1976

[51] Int. Cl.[2] ..... A45F 1/08; A45F 1/10

[52] U.S. Cl. ..... 135/14 D; 52/2; 47/26

[58] Field of Search ..... 135/140; 160/179, DIG. 8; 52/2; 9/11 R, 11 A; 47/26

[56] References Cited

U.S. PATENT DOCUMENTS

| | | | |
|---|---|---|---|
| 1,057,628 | 4/1913 | Eberhardt | 135/1 R |
| 2,041,258 | 5/1936 | Mitchell | 160/DIG. 8 |
| 2,560,661 | 7/1951 | Poovey | 160/DIG. 8 |
| 2,699,826 | 1/1955 | Emerson | 160/DIG. 8 |
| 2,977,106 | 3/1961 | Duff | 52/2 |
| 3,136,356 | 6/1964 | Mears | 160/87 |
| 3,782,399 | 1/1974 | Milner | 135/14 D |
| 3,826,300 | 7/1974 | Lee | 160/179 |

OTHER PUBLICATIONS

Popular Mechanics Magazine, Dec. 1962, p. 147.

*Primary Examiner*—Werner H. Schroeder
*Assistant Examiner*—Conrad L. Berman

[57] ABSTRACT

An improvement in a lightweight camper's tent having a special combination of entry and support means wherein the support means opens and closes to permit the camper to enter and erect the canopies of the tent from the inside after entry. This arrangement is unique and allows the camper the alternative of sleeping in the open until the weather dictates that the tent be closed and this said closing may then be accomplished from the inside.

5 Claims, 11 Drawing Figures

CAMPERS TENTING WITH A COMBINATION OF ENTRY AND SUPPORT MEANS

BACKGROUND OF THE INVENTION

There are many kinds of lightweight tents, all of which have certain qualities and are designed for various purposes. These tents have had a variety of support means which include hardware frames for support that have been placed inside and outside of the tenting material. These tents take considerable time and trouble to assemble and limit the mobility of the camper. Furthermore, the various hardware, ropes and support means systems parts are bulky and clumsy and often difficult to pack. Another means by which tents have been supported is by gas inflated chambers so arranged to support various tent and shelter designs. The disadvantage to these systems has been their weight and the quantity of gas necessary to inflate them. The basic concept of gas inflated tenting has the advantage of being void of the clumsy hardware that is usually associated with tenting. The entry means of all these tents has been with a mechanical system, separate from the support means, such as a zipper, or a buttoned flap. These systems have been satisfactory, but do not have the utility of allowing the camper to open and close the tent conveniently from a position inside. Existing tenting does not give a camper the potential to sleep out and then gain shelter without moving his place of rest. The purpose of this invention is to provide a lightweight, mechanically simple tent that can be manipulated from the inside or out, giving the camper a more convenient device for outdoor sleeping.

SUMMARY OF THE INVENTION

Among the several objects of the invention may be noted the provision of an improved, small tent for campers, particularly for back packers, but also useful by any person sleeping out of doors. The tent comprises a floor portion, a head canopy portion, and a foot canopy portion, wherein the floor portion has at least four sides, each canopy portion is attached to at least two sides of the floor portion and has an edge that is unattached to the floor portion, the unattached edges of the two canopies forming a closeable entrance to the tent, and means associated with the unattached edge of each canopy to accommodate support means, the two canopy support means being adapted to cooperate with each other to close the tent.

A BRIEF DESCRIPTION OF THE DRAWINGS

DESCRIPTION OF PREFERRED EMBODIMENT

Figure 1:
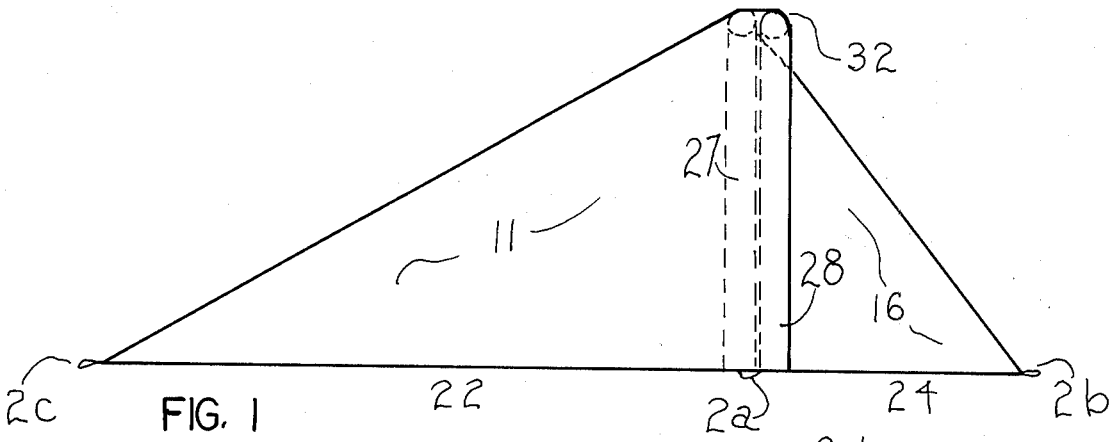
FIG. 1 is a side view of the tent in an erected position.
Figure 2:
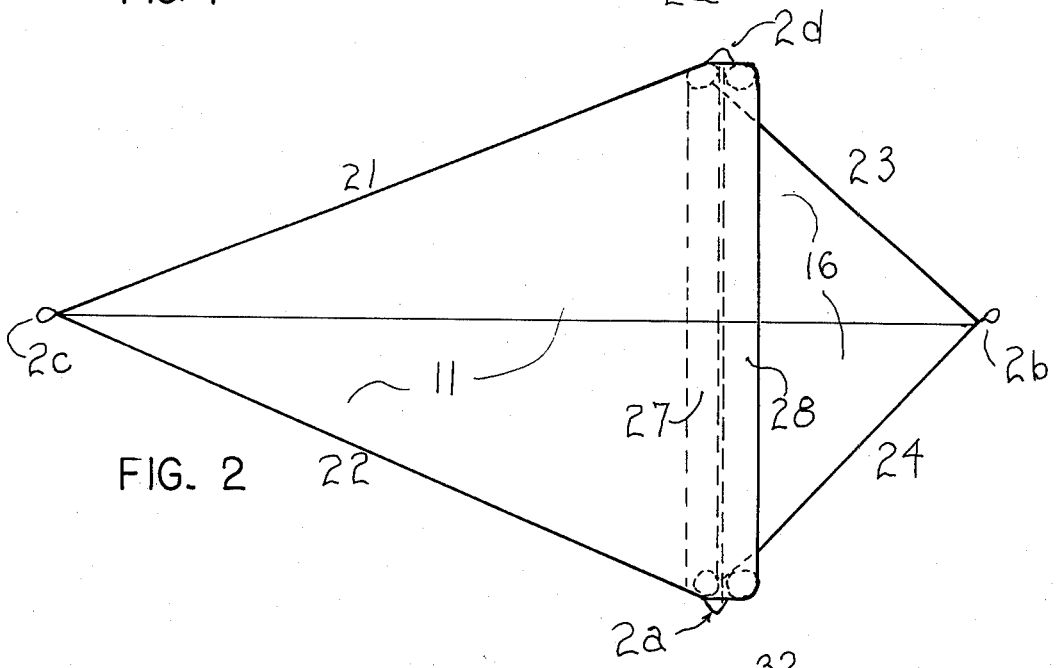
FIG. 2 is a top view of the tent in an erected position.
Figure 3:
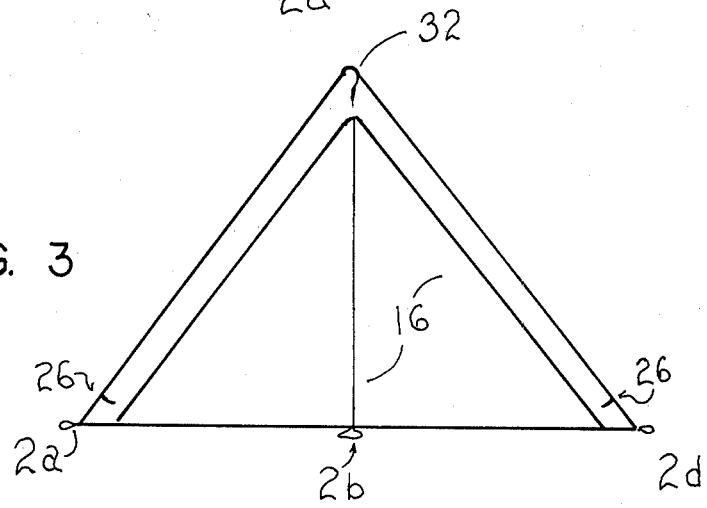
FIG. 3 is an end view of the tent in an erected position.
Figure 4:
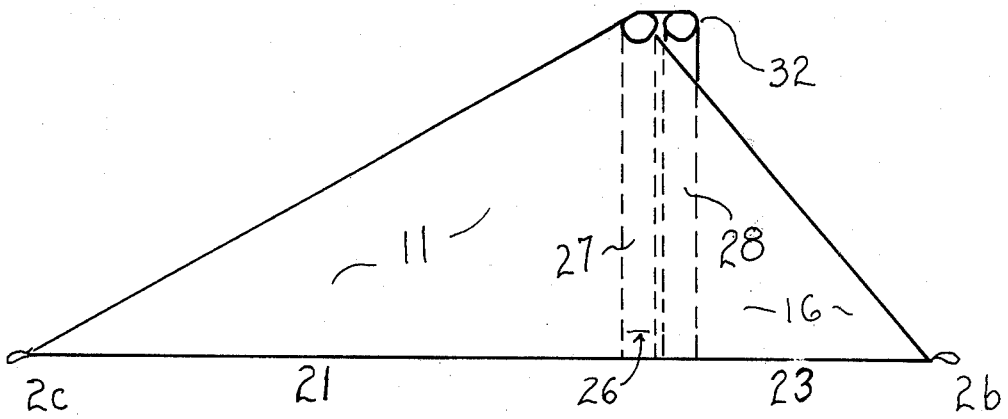
FIG. 4 shows a cross section of the tent dividing it longitudinally.

Referring to the drawings, a camping tent made in accordance with this invention is shown to be comprised of a floor portion with the configuration of a kite-shaped quadrangle and designated as 1, with loops of sewn cloth, or other material, as shown at *2a, 2b, 2c,* and *2d,* and attached to the four corners of the floor portion for the purpose of stretching said tent and attaching it to the ground. The floor portion has two long sides, 3 and 4, and two short sides, 5 and 6, with the two long sides forming an angle, 7, at the foot end of the tent and the two short sides forming an angle, 8, at the head end of the tent and with one long side joining to one side at the angles, 9 and 10, where the side corners of the tent are located. The tent also comprises a foot canopy, 11, with quadrangular shape, the long sides of which, 12 and 13, are of the same length as the long sides, 3 and 4, of the floor portion and the short sides, 14 and 15, are of a combined length longer than te transversal, 31, across the floor between the two side angles, 9 and 10. Likewise, there is a head canopy, 16, two sides, 17 and 18, of which are of the same length as the sides of the floor portion that form the angle, 8 at the head end of the tent and the other sides of the head canopy, 19 and 20, are of a greater combined length than the distance across the transversal, 31, between the two side angles, 9 and 10. The foot canopy is attached to the floor portion, joining in seams, 21 and 22, the sides of corresponding lengths, 3 to 12 and 4 to 13, one seam on each side of the tent floor. Also the sides, 17 and 18, of the head canopy, 16, are joined in seams, 23 and 24, to the sides of the floor of corresponding lengths, 5 to 17 and 6 to 18. Tubular pockets, 27 and 28, are attached to the free margins, 14 and 15 and 19 and 20, of the two canopies. Each of these tubular pockets is adapted to receive an inflatable tube, 25, which may be inserted into the pocket through an opening, 26. The inflatable tubes may be made of any airtight material and their dimensions are such that when they are inflated the tubes essentially fill the pockets and cause them to form angular arches, 32. The ends, 33, of the tubular pocket, 27, of the head canopy are attached to the tent floor at angles, 9 and 10. Likewise the end, 34, of the tubular pocket, 28, of the foot canopy is attached to the triangular extensions of the floor, 35 and 36. When the tent is closed, these inflated arches overlap, with the inflated pocket, 28, of the foot canopy overriding the inflated pocket of the head canopy, 27. The effect of this circumstance is to stiffen the canopies of the invention and cause them to stand up so that the angles, 29 and 30, of the canopies, that are adjacent to the plane of the transversal, 31, take a vertical posture parallel to said plane.

Figure 5:
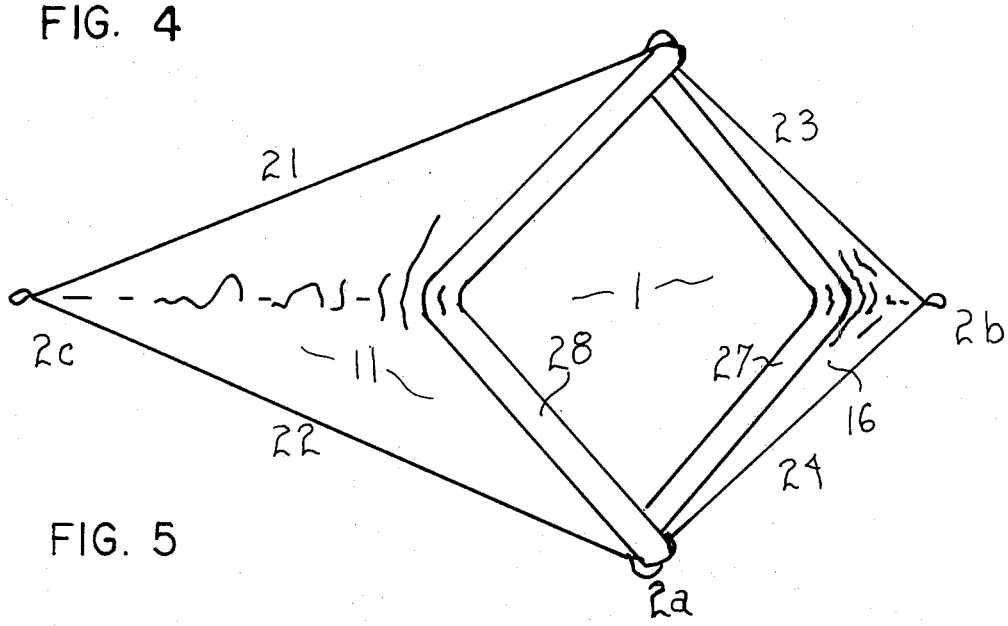
FIG. 5 shows a top view of the tent with the canopies in a relaxed position.
Figure 6:
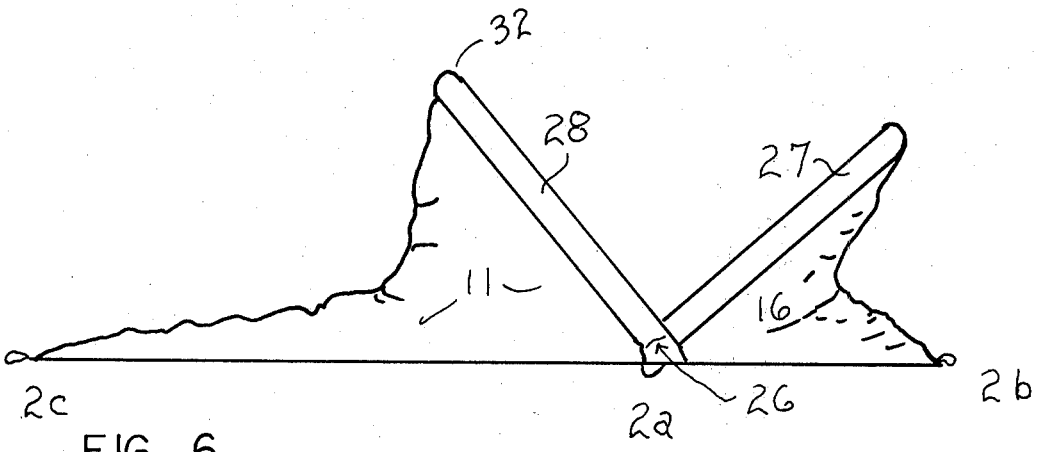
FIG. 6 shows a side view of the tent with the canopies in a relaxed position.
Figure 7:
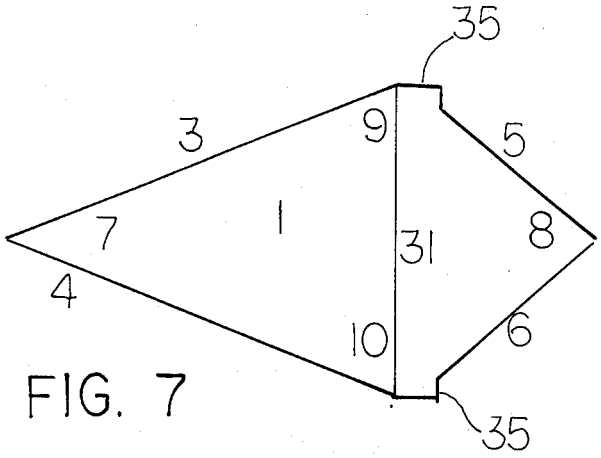
FIG. 7 is a top view of the tent floor.
Figure 8:
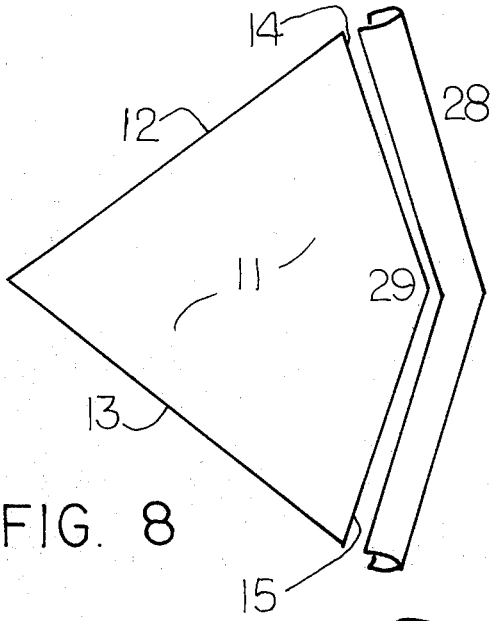
FIG. 8 is a top view of the tent's foot canopy showing the pocket prior to its attachment to the canopy and before the attachment of said canopy to the floor portion.
Figure 9:
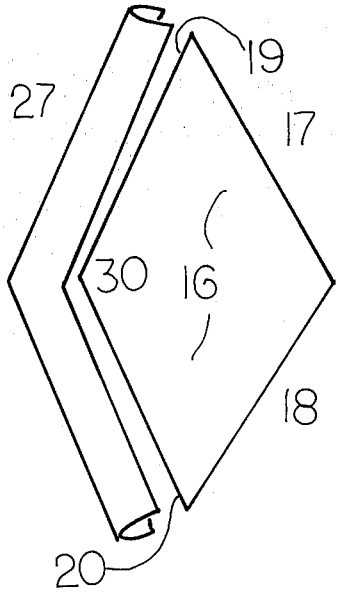
FIG. 9 is a top view of the head canopy showing the pocket prior to its attachment to the canopy and before the attachment of said canopy to the floor portion.
Figure 11:
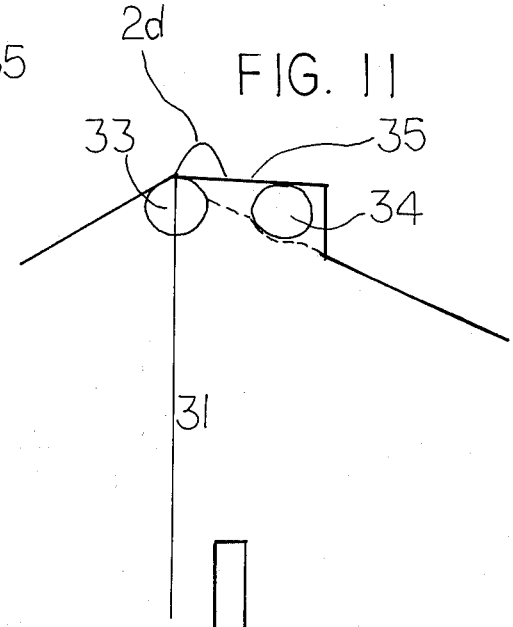
FIG. 11 shows a triangular extension attached to one side of the tent floor, as well as the attachment of the tubular pockets to the floor and extension.
Figure 10:
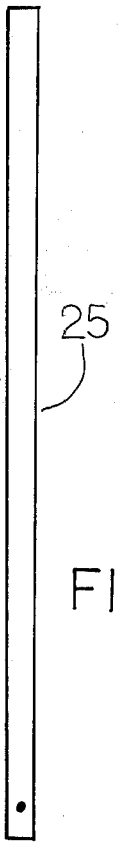
FIG. 10 is a view of the inflatable tube used as a stiffening agent in the canopies' pockets.

To open the tent, the two canopies are separated by pulling the inflated pocket, 28, of the head canopy out from under the pocket of the foot canopy, 27, as is shown in FIG. 5 and FIG. 6.

It is easily seen that the combination of support means with entry means in a camper's tent is not necessarily limited to the use of a gas filled pocket for support. The concept could also use a pair of wooden, metal or plastic bows inserted in the pocket portions of the canopies and the tent would function equally as well as it would with the gas filled innertubes to inflate the pockets. The use of gas filled innertubes to inflate the pockets is the preferred embodiment because it limits the use of various hardware, but is not considered the only means of utilizing this concept. It is also apparent that the particular shape of the preferred embodiment of the invention is not meant to limit the concept in its application. The combination of support means of a camper's tent and the entry means lends utility to several shapes that could be used in the floor and canopy portions of said tents. Furthermore, the concept set forth is exclusive of any particular tenting material and any particular airtight material formation that could be used in the innertubes of the inflated pockets and also the concept set forth in this invention is consistent with the possibility of an airtight cell being attached directly to the canopies of the tent and thus eliminating the need for pockets of the preferred embodiment.

What is claimed is:

1. A top opening tent comprising a floor portion, a foot canopy portion, and a head canopy portion, wherein the floor portion has at least four sides, each canopy portion is attached to at lest two sides of the floor portion and has an edge unattached to the floor portion, the unattached edges of the canopies facing each other and being adjusted to form an arcuate closeable entrance to the tent, the unattached edge of each canopy including elongated support means, whereby the tent may be closed when the support means are in place, by causing the unattached edge of one canopy to overide the unattached edge of the other canopy to form an arched support means and a closed tent.

2. A tent as defined by claim 1 wherein the floor portion has four sides.

3. A tent as defined in claim 2 wherein the head canopy is attached to two adjacent sides of the floor portion and the foot canopy is attached to the other two adjacent sides of the floor portion.

4. A tent as defined in claim 3 wherein the unattached edge of each canopy forms a tubular pocket.

5. A tent as defined in claim 4 wherein the support means for each canopy is an inflated tube.

* * * * *